US010593317B1

(12) United States Patent
Bastyr et al.

(10) Patent No.: US 10,593,317 B1
(45) Date of Patent: Mar. 17, 2020

(54) REDUCING AUDIBILITY OF SENSOR NOISE FLOOR IN A ROAD NOISE CANCELLATION SYSTEM

(71) Applicant: Harman International Industries, Incorporated, Stamford, CT (US)

(72) Inventors: Kevin J. Bastyr, Franklin, MI (US); James May, Milford, MI (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 16/227,506

(22) Filed: Dec. 20, 2018

(51) Int. Cl.
*G10K 11/178* (2006.01)

(52) U.S. Cl.
CPC .. *G10K 11/17823* (2018.01); *G10K 11/17853* (2018.01); *G10K 2210/12821* (2013.01); *G10K 2210/3028* (2013.01); *G10K 2210/3044* (2013.01)

(58) Field of Classification Search
None
See application file for complete search history.

(56) References Cited

U.S. PATENT DOCUMENTS

2012/0316872 A1* 12/2012 Stoltz ..... G10L 21/0216 704/233
2017/0076712 A1* 3/2017 Christoph ..... G10K 11/178

* cited by examiner

*Primary Examiner* — James K Mooney
(74) *Attorney, Agent, or Firm* — Brooks Kushman P.C.

(57) ABSTRACT

A road noise cancellation (RNC) system may include a controller and attenuator for reducing the audibility of the noise floor caused by the system's vibration sensors. A level of anti-noise at a location in a passenger cabin that may be attributed to the sensor noise floor may be estimated. An actual sound level in the passenger cabin may be measured or estimated, with the sensor noise floor component algorithmically removed. The difference in levels may be compared to a predetermined threshold to determine an amount of attenuation, if any, to be applied to an anti-noise signal to reduce audibility.

20 Claims, 5 Drawing Sheets

REDUCING AUDIBILITY OF SENSOR NOISE FLOOR IN A ROAD NOISE CANCELLATION SYSTEM

TECHNICAL FIELD

The present disclosure is directed to road noise cancellation and, more particularly, to reducing the audibility of the sensor noise floor in a road noise cancellation system.

BACKGROUND

Active Noise Control (ANC) systems attenuate undesired noise using feedforward and feedback structures to adaptively remove undesired noise within a listening environment, such as within a vehicle cabin. ANC systems generally cancel or reduce unwanted noise by generating cancellation sound waves to destructively interfere with the unwanted audible noise. Destructive interference results when noise and "anti-noise," which is largely identical in magnitude but opposite in phase to the noise, combine to reduce the sound pressure level (SPL) at a location. In a vehicle cabin listening environment, potential sources of undesired noise come from the engine, the interaction between the vehicle's tires and a road surface on which the vehicle is traveling, and/or sound radiated by the vibration of other parts of the vehicle. Therefore, unwanted noise varies with the speed, road conditions, and operating states of the vehicle.

A Road Noise Cancellation (RNC) system is a specific ANC system implemented on a vehicle in order to minimize undesirable road noise inside the vehicle cabin. RNC systems use vibration sensors to sense road induced vibrations generated from the tire and road interface that leads to unwanted audible road noise. This unwanted road noise inside the cabin is then cancelled, or reduced in level, by using speakers to generate sound waves that are ideally opposite in phase and identical in magnitude to the noise to be reduced at the typical location of one or more listeners' ears. Cancelling such road noise results in a more pleasurable ride for vehicle passengers, and it enables vehicle manufacturers to use lightweight materials, thereby decreasing energy consumption and reducing emissions.

RNC systems are typically Least Mean Square (LMS) adaptive feed-forward systems that continuously adapt W-filters based on both acceleration inputs from the vibration sensors located in various positions around a vehicle's suspension system and on signals of error microphones located in various positions inside the vehicle's cabin. RNC systems in vehicles are susceptible to the noise floor from the vibration sensors or microphones undesirably adding to the total noise within the passenger cabin. The noise floor is the level of background noise in a signal, or the level of noise introduced by the system, below which the signal that's being captured cannot be isolated from the noise. For instance, the noise floor for a vibration sensor, such as an accelerometer, is the output signal it has when it is not subjected to any input vibration. An ideal accelerometer would have an output signal with zero amplitude when subjected to zero road input vibration. A real accelerometer output signal in this case would not be zero, but would have a very small amplitude. Because most RNC systems are feed-forward systems, non-zero noise floor signals from the vibration sensors and/or microphones are amplified and radiated by speakers into the passenger cabin as airborne anti-noise. On certain roads at certain speeds (e.g., on a smooth road at low speed), the sensor noise floor may be audible inside a vehicle with a low in-cabin noise floor, much to the annoyance of passengers.

SUMMARY

Various aspects of the present disclosure relate to reducing the audibility of a sensor noise floor in a road noise cancellation (RNC) system. In one or more illustrative embodiments, a method for reducing the audibility of a sensor noise floor in a feed-forward RNC system is provided. The method may include: estimating a sensor noise floor anti-noise (SNFAN) level, the SNFAN level representing an amount of anti-noise at a location in a passenger cabin of a vehicle due to a noise floor of at least one sensor; determining an in-cabin sound level in the passenger cabin; and adjusting an attenuation level of an anti-noise signal to be radiated into the passenger cabin by at least one speaker based on a comparison of the in-cabin sound level to the SNFAN level.

Implementations may include one or more of the following features. The SNFAN level and the in-cabin sound level may be sound pressure levels. Alternately, the SNFAN level and the in-cabin sound level may be sound parameters computed in one or more frequency bands. Estimating the SNFAN level may include: for at least one speaker in the RNC system, multiplying the noise floor of the at least one sensor by W-filter coefficients associated with the at least one speaker; summing the products of the noise floor and the W-filter; and multiplying the sum by an estimated secondary path, S'(z), between the at least one speaker and the location in the passenger cabin. The in-cabin sound level may be based on a direct measurement of sound pressure by a microphone in the passenger cabin. Alternatively, the in-cabin sound level may be estimated based on inputs from in-cabin sound generating systems.

Determining an in-cabin sound level in the passenger cabin may include: measuring a sound pressure level using a microphone in the passenger cabin; and removing a component of the sound pressure level attributed to anti-noise radiated by the at least one speaker. Adjusting the attenuation level of an anti-noise signal may include: calculating a difference between the in-cabin sound level and the SNFAN level; and selecting the attenuation level based on the difference. Selecting the attenuation level based on the difference may include selecting the attenuation level from a lookup table based on the difference. The attenuation level may be set to zero when the difference exceeds a predetermined threshold.

One or more additional embodiments of the present disclosure are directed to an RNC system for a vehicle. The RNC system may comprise at least one sensor configured to generate a noise signal in response to an input, the sensor having a noise floor, and a controller including a processor and memory. The controller may be programmed to: estimate a sensor noise floor anti-noise (SNFAN) level, the SNFAN level representing an amount of anti-noise at a location in a passenger cabin of the vehicle due to the noise floor of the at least one sensor; determine an in-cabin sound level in the passenger cabin; and set an attenuation level based on a comparison of the in-cabin sound level to the SNFAN level. The RNC system may further include an attenuator configured receive an anti-noise signal from a controllable filter and generate an attenuated anti-noise signal to be radiated into the passenger cabin as anti-noise by at least one speaker based on the attenuation level.

Implementations may include one or more of the following features. The SNFAN level and the in-cabin sound level may be sound pressure levels. Alternately, the SNFAN level and the in-cabin sound level may be sound parameters computed in one or more frequency bands. The controller being programmed to estimate the SNFAN level may include the controller being programmed to: for the at least one speaker in the RNC system, multiply the noise floor of the at least one sensor by W-filter coefficients associated with the at least one speaker; sum the products of the noise floor and W-filter coefficients; and multiply the sum by an estimated secondary path, S'(z), between the at least one speaker and the location in the passenger cabin. The noise floor may be obtained from actual output signals from the at least one sensor. Alternatively, the noise floor may be a programmed value. The attenuation level set by the controller may be based on a difference between the in-cabin sound level and the SNFAN level.

One or more additional embodiments of the present disclosure are directed to a computer-program product embodied in a non-transitory computer readable medium that is programmed for RNC. The computer-program product may include instructions for: receiving a noise signal from at least one sensor; comparing the noise signal to a stored noise floor value indicative of an estimate of a sensor noise floor for the at least one sensor; and adjusting an attenuation level of an anti-noise signal to be radiated into the passenger cabin by at least one speaker based on the comparison of the noise signal to the stored noise floor value.

Implementations may include one or more of the following features. The instructions for comparing the noise signal to a stored noise floor value may comprise calculating a difference between the noise signal and the stored noise floor value and comparing the difference to a predetermined threshold. The instructions for adjusting the attenuation level of an anti-noise signal may comprise selecting the attenuation level when the difference does not exceed the predetermined threshold, wherein the attenuation level is based on the difference.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Any one or more of the controllers or devices described herein include computer executable instructions that may be compiled or interpreted from computer programs created using a variety of programming languages and/or technologies. In general, a processor (such as a microprocessor) receives instructions, for example from a memory, a computer-readable medium, or the like, and executes the instructions. A processing unit includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof.

Figure 1:
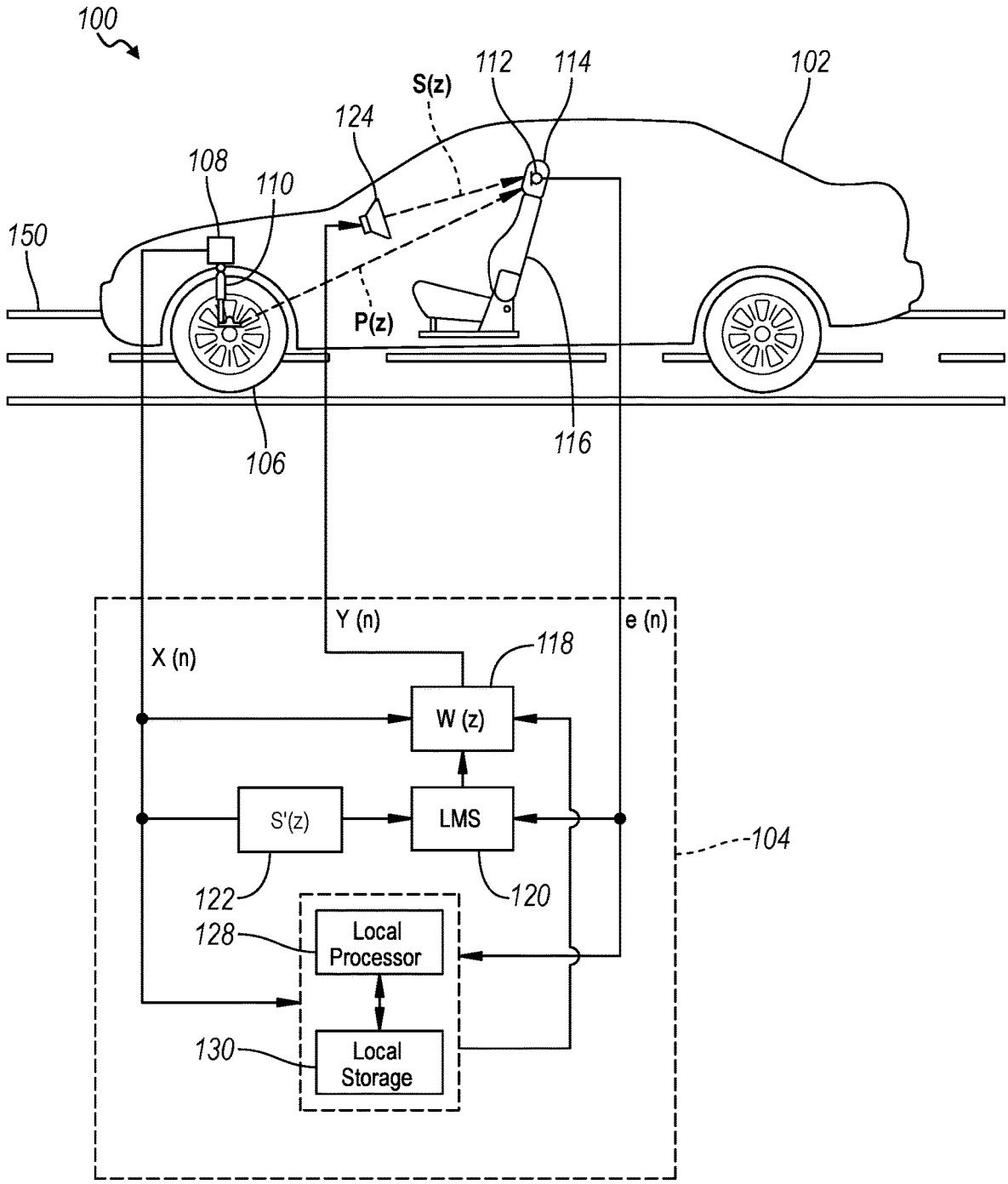
FIG. 1 is a block diagram of a vehicle having a road noise cancellation (RNC) system, in accordance with one or more embodiments of the present disclosure.

FIG. 1 shows a road noise cancellation (RNC) system 100 for a vehicle 102 having one or more vibration sensors 108. The vibration sensors are disposed throughout the vehicle 102 to monitor the vibratory behavior of the vehicle's suspension, subframe, as well as other axle and chassis components. The RNC system 100 may be integrated with a broadband feed-forward and feedback active noise control (ANC) framework or system 104 that generates anti-noise by adaptive filtering of the signals from the vibration sensors 108 using one or more microphones 112. The anti-noise signal may then be played through one or more speakers 124. S(z) represents a transfer function between a single speaker 124 and a single microphone 112. While FIG. 1 shows a single vibration sensor 108, microphone 112, and speaker 124 for simplicity purposes only, it should be noted that typical RNC systems use multiple vibration sensors 108 (e.g., 10 or more), speakers 124 (e.g., 4 to 8), and microphones 112 (e.g., 4 to 6).

The vibration sensors 108 may include, but are not limited to, accelerometers, force gauges, geophones, linear variable differential transformers, strain gauges, and load cells. Accelerometers, for example, are devices whose output signal amplitude is proportional to acceleration. A wide variety of accelerometers are available for use in RNC systems. These include accelerometers that are sensitive to vibration in one, two and three typically orthogonal directions. These multi-axis accelerometers typically have a separate electrical output (or channel) for vibrations sensed in their X-direction, Y-direction and Z-direction. Single-axis and multi-axis accelerometers, therefore, may be used as vibration sensors 108 to detect the magnitude and phase of acceleration and may also be used to sense orientation, motion, and vibration.

Noise and vibrations that originate from a wheel 106 moving on a road surface 150 may be sensed by one or more of the vibration sensors 108 mechanically coupled to a suspension device 110 or a chassis component of the vehicle 102. The vibration sensor 108 may output a noise signal X(n), which is a vibration signal that represents the detected road-induced vibration. It should be noted that multiple vibration sensors are possible, and their signals may be used separately, or may be combined in various ways known by those skilled in the art. In certain embodiments, a microphone may be used in place of a vibration sensor to output the noise signal X(n) indicative of noise generated from the interaction of the wheel 106 and the road surface 150. The noise signal X(n) may be filtered with a modeled transfer characteristic S'(z), which estimates the secondary path (i.e., the transfer function between an anti-noise speaker 124 and an error microphone 112), by a secondary path filter 122.

Road noise that originates from interaction of the wheel 106 and the road surface 150 is also transferred, mechanically and/or acoustically, into the passenger cabin and is received by the one or more microphones 112 inside the vehicle 102. The one or more microphones 112 may, for example, be located in a headrest 114 of a seat 116 as shown in FIG. 1. Alternatively, the one or more microphones 112 may be located in a headliner of the vehicle 102, or in some other suitable location to sense the acoustic noise field heard by occupants inside the vehicle 102. The road noise originating from the interaction of the road surface 150 and the wheel 106 is transferred to the microphone 112 according to a transfer characteristic P(z), which represents the primary path (i.e., the transfer function between an actual noise source and an error microphone).

The microphones 112 may output an error signal e(n) representing the noise present in the cabin of the vehicle 102 as detected by the microphones 112. In the RNC system 100, an adaptive transfer characteristic W(z) of a controllable filter 118 may be controlled by adaptive filter controller 120, which may operate according to a known least mean square (LMS) algorithm based on the error signal e(n) and the noise signal X(n) filtered with the modeled transfer characteristic S'(z) by the filter 122. The controllable filter 118 is often referred to as a W-filter. An anti-noise signal Y(n) may be generated by an adaptive filter formed by the controllable filter 118 and the adaptive filter controller 120 based on the identified transfer characteristic W(z) and the vibration signal, or a combination of vibration signals, X(n). The anti-noise signal Y(n) ideally has a waveform such that when played through the speaker 124, anti-noise is generated near the occupants' ears and the microphone 112 that is substantially opposite in phase and identical in magnitude to that of the road noise audible to the occupants of the vehicle cabin. The anti-noise from the speaker 124 may combine with road noise in the vehicle cabin near the microphone 112 resulting in a reduction of road noise-induced sound pressure levels (SPL) at this location. In certain embodiments, the RNC system 100 may receive sensor signals from other acoustic sensors in the passenger cabin, such as an acoustic energy sensor, an acoustic intensity sensor, or an acoustic particle velocity or acceleration sensor to generate error signal e(n).

While the vehicle 102 is under operation, a processor 128 may collect and optionally processes the data from the vibration sensors 108 and the microphones 112 to construct a database or map containing data and/or parameters to be used by the vehicle 102. The data collected may be stored locally at a storage 130, or in the cloud, for future use by the vehicle 102. Examples of the types of data related to the RNC system 100 that may be useful to store locally at storage 130 include, but are not limited to, optimal W-filters, accelerometer or microphone spectra or time dependent signals, and engine SPL versus Torque and RPM, and the noise floor of one or more accelerometers. In one or more embodiments, the processor 128 and storage 130 may be integrated with one or more RNC system controllers, such as the adaptive filter controller 120.

As previously described, typical RNC systems may use several vibration sensors, microphones and speakers to sense structure-borne vibratory behavior of a vehicle and generate anti-noise. The vibrations sensor may be multi-axis accelerometers having multiple output channels. For instance, triaxial accelerometers typically have a separate electrical output for vibrations sensed in their X-direction, Y-direction, and Z-direction. A typical configuration for an RNC system may have, for example, 6 error microphones, 6 speakers, and 12 channels of acceleration signals coming from 4 triaxial accelerometers or 6 dual-axis accelerometers. Therefore, the RNC system will also include multiple S'(z) filters (i.e., secondary path filters 122) and multiple W(z) filters (i.e., controllable filters 118).

The simplified RNC system schematic depicted in FIG. 1 shows one secondary path, represented by S(z), between each speaker 124 and each microphone 112. As previously mentioned, RNC systems typically have multiple speakers, microphones and vibration sensors. Accordingly, a 6-speaker, 6-microphone RNC system will have 36 total secondary paths (i.e., 6×6). Correspondingly, the 6-speaker, 6-microphone RNC system may likewise have 36 S'(z) filters (i.e., secondary path filters 122), which estimate the transfer function for each secondary path. As shown in FIG. 1, an RNC system will also have one W(z) filter (i.e., controllable filter 118) between each noise signal X(n) from a vibration sensor (i.e., accelerometer) 108 and each speaker 224. Accordingly, a 12-accelerometer signal, 6-speaker RNC system may have 72 W(z) filters. The relationship between the number of accelerometer signals, speakers, and W(z) filters is illustrated in FIG. 2.

Figure 2:
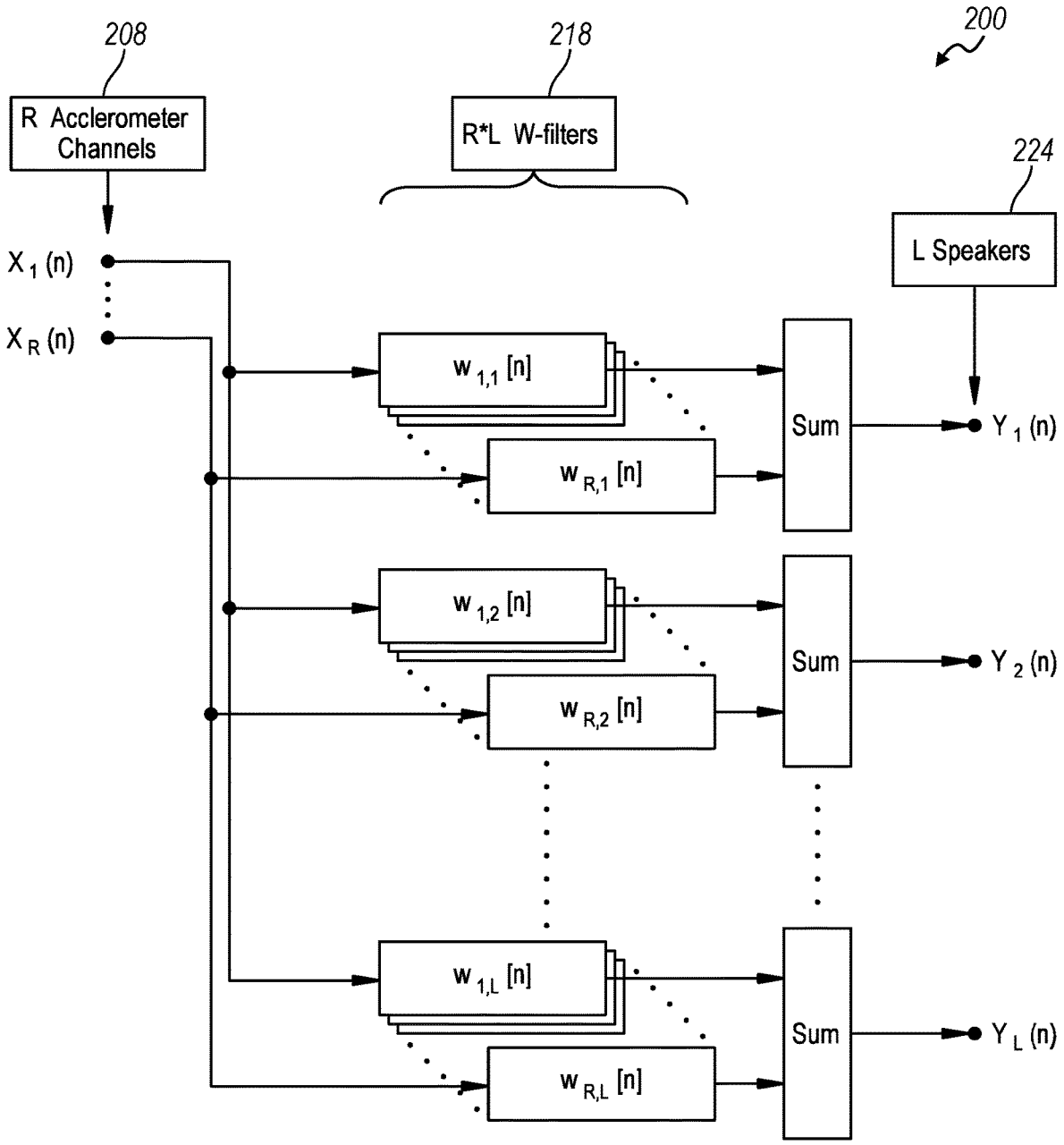
FIG. 2 is a sample schematic diagram demonstrating relevant portions of an RNC system scaled to include R accelerometer signals and L speaker signals.

FIG. 2 is a sample schematic diagram demonstrating relevant portions of an RNC system 200 scaled to include R accelerometer signals [X1(*n*), X2(*n*), . . . XR(n)] from accelerometers 208 and L speaker signals [Y1(*n*), Y2(*n*), . . . YL(n)] from speakers 224. Accordingly, the RNC system 200 may include R*L controllable filters (or W-filters) 218 between each of the accelerometer signals and each of the speakers. As an example, an RNC system having 12 accelerometer outputs (i.e., R=12) may employ 6 dual-axis accelerometers or 4 triaxial accelerometers. In the same example, a vehicle having 6 speakers (i.e., L=6) for reproducing anti-noise, therefore, may use 72 W-filters in total. At each of the L speakers, R W-filter outputs are summed to produce the speaker's anti-noise signal Y(n). Each of the L speakers may include an amplifier (not shown). In one or more embodiments, the R accelerometer signals filtered by the R W-filters are summed to create an electrical anti-noise signal y(n), which is fed to the amplifier to generate an amplified anti-noise signal Y(n) that is sent to a speaker.

As previously described, RNC systems in vehicles may be susceptible to the noise floor from the feedforward vibration sensors or microphones undesirably adding to the total noise within the passenger cabin. This occurs because the lowest sensor output signal amplitude is not zero. The noise floor of a vibration sensor, such as an accelerometer, is the level of output signal it has when it is not subjected to any input vibration. An ideal accelerometer would have an output signal amplitude of zero when subjected to no vibration. A real accelerometer output signal in this case would not be zero, but would have a very small amplitude. Also, in a real RNC system, certain very small amplitude road vibrations are not of sufficient amplitude to create a higher amplitude signal than the accelerometer noise floor. Similarly, the microphone noise floor is the signal a microphone outputs when it is not subjected to any acoustic pressure.

Because most RNC systems are feed-forward systems, any noise signals, including the noise floor, are filtered or equalized by the LMS adapted W-filters to generate an anti-noise signal when RNC is active. The anti-noise signal is then amplified and sent directly to the speakers, where it becomes airborne anti-noise. When the sensor noise floor dominates other inputs sensed by the sensor, deactivating the RNC system can prevent the sensor noise floor from being amplified and becoming audible within the passenger cabin. For instance, when a vehicle is stationary, deactivating the RNC system may prevent the sensor noise floor from generating audible noise within the passenger cabin. The sensor noise floor may still be audible within the passenger cabin even at non-zero speeds, for example, when a vehicle is traveling at relatively low speed on smooth pavement. In contrast, when a vehicle travels at the same low speed on rough pavement, the sensor background noise may not be audible, as road-induced vibrations are of higher amplitude than the sensor noise floor at all frequencies. On this rough road, a quieter in-cabin experience may be provided by the RNC system being active. Thus, activating RNC based only on a vehicle speed threshold may be an inadequate means of providing the best RNC experience while suppressing the amplified sensor noise floor.

To prevent the noise floor from being amplified and radiated as audible noise within the passenger cabin, a smart, road-induced vibration dependent level for RNC turn-on may be employed. According to one or more embodiments, a magnitude threshold applied to a single accelerometer output signal may be utilized, possibly in conjunction with a speed-based threshold. As an example, on rough pavement types (i.e., those with relatively high accelerometer output signal amplitude), RNC may turn on below 5 mph. On smoother pavement types (i.e., those with relatively lower accelerometer output signal amplitude), RNC may turn on at 10 to 20 mph. Some RNC algorithms run at a 1.5 kHz sample rate, which means the antialiasing filter limits the frequency range to 750 Hz. It is the sensor noise floor in the upper 1.2 octaves of this range (i.e., 325 Hz to 750 Hz) that is typically particularly audible in vehicles. Different RNC algorithms having different sample rates operating on different pavement types with different accelerometers may have other frequency regions where feedforward sensor noise floor may be audible in the vehicle interior at certain speeds.

Figure 3:
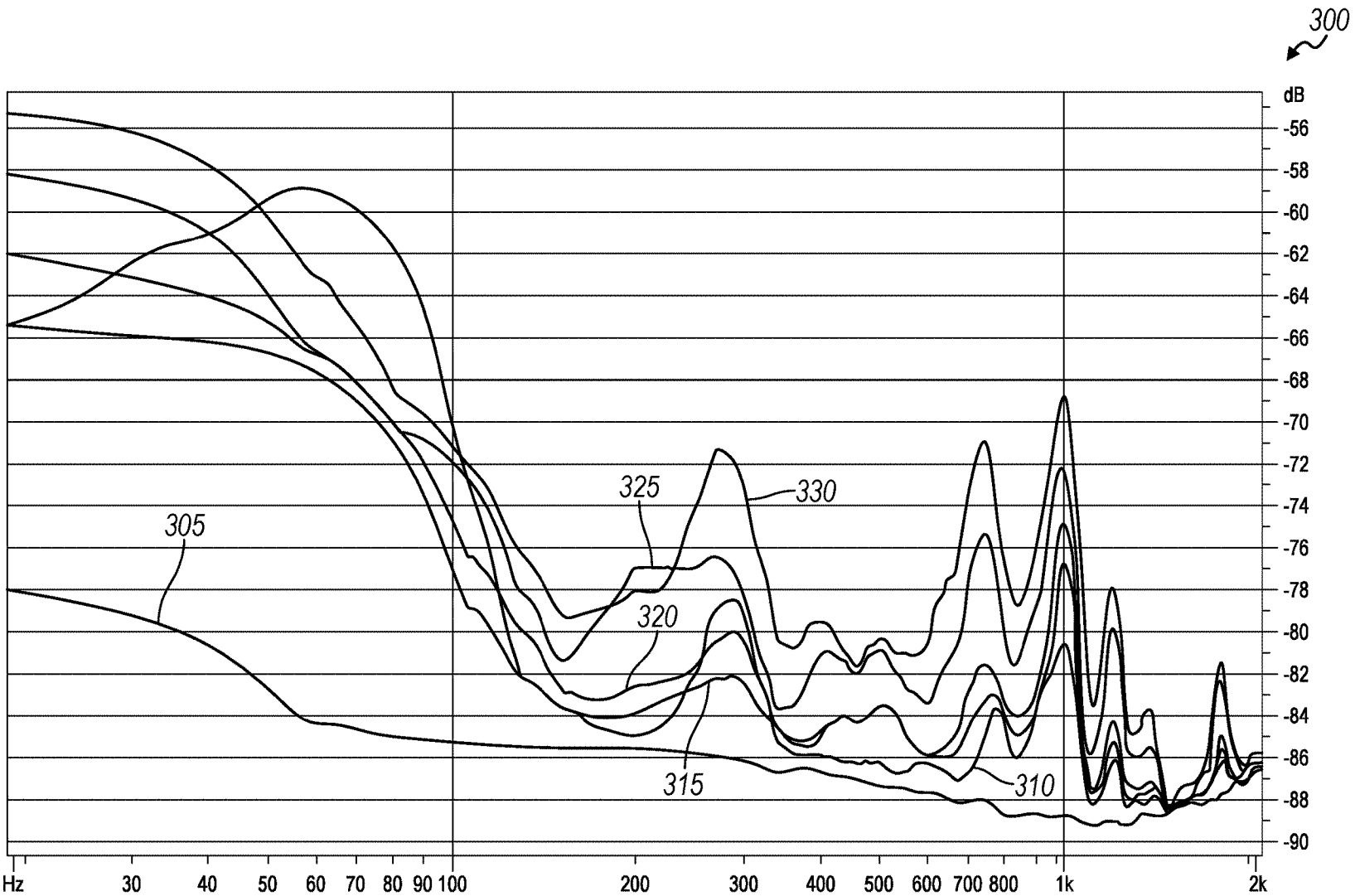
FIG. 3 illustrates a spectrum of time data output by an accelerometer mounted on the subframe of a vehicle traveling at various speeds on relatively new, smooth pavement.

To illustrate a typical case, FIG. 3 shows a spectrum 300 of time data output by an accelerometer mounted on the subframe of a vehicle traveling at various speeds on relatively new, smooth pavement, hereafter termed a frequency response. Signal 305 depicts the frequency response of a vibration sensor when the vehicle is turned off. Signal 310 depicts the frequency response when the vehicle is idling. Signal 315 depicts the frequency response when the vehicle is travelling at 3 mph. Signal 320 depicts the frequency response when the vehicle is travelling at 5 mph. Signal 325 depicts the frequency response when the vehicle is travelling at 13 mph. Finally, signal 330 depicts the frequency response when the vehicle is travelling at 18 mph. Of interest is that the acceleration output signal 330 at 18 mph is only approximately 6 dB above the noise floor, as indicated by signal 305, in the 300-600 Hz octave, which is the frequency range where the accelerometer noise floor is most audible in a passenger cabin. For comparison, on typical roads at 45 mph, the road-induced acceleration signal may be 40 dB or more above the accelerometer background noise level. Note that these lines are not always offset from each other, as in some frequency ranges they cross. In an embodiment, longer time averaging can be used to arrive at a more accurate estimate of the frequency response.

Figure 4:
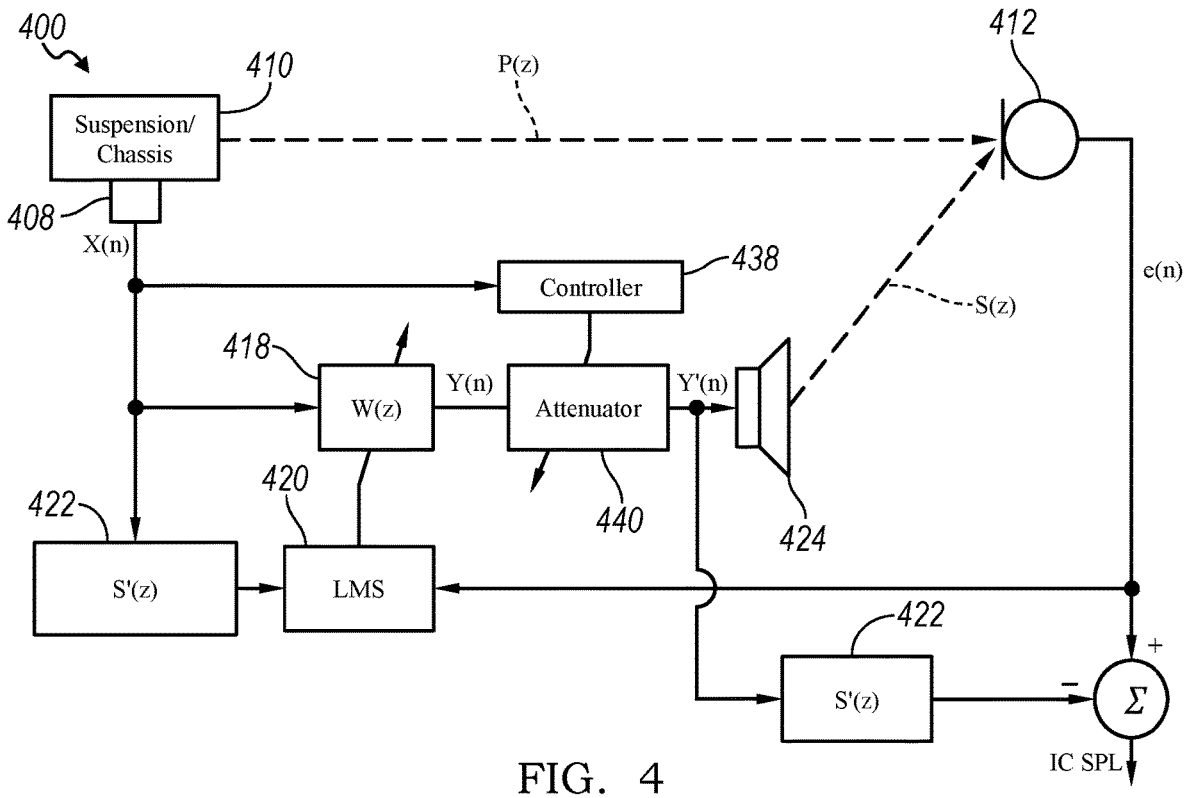
FIG. 4 is a schematic block diagram representing an RNC system including a controller and an attenuator, in accordance with one or more embodiments of the present disclosure.

FIG. 4 is a schematic block diagram representing an RNC system 400, in accordance with one or more embodiments of the present disclosure. Similar to RNC system 100, the RNC system 400 may include elements 408, 410, 412, 418, 420, 422, and 424, consistent with operation of elements 108, 110, 112, 118, 120, 122, and 124, respectively, discussed above. FIG. 4 also shows the primary path P(z) and secondary path S(z), as described with respect to FIG. 1, in block form for illustrative purposes. As shown, the RNC system 400 may further include a controller 438. The controller 438 may include a processor and memory (not shown), such as processor 128 and storage 130, programmed to prevent the sensor noise floor from being audible in the passenger cabin.

Because the feed forward sensor's noise floor is not correlated to the road induced vibration, any anti-noise generated from the noise floor component of the noise signal will not result in noise cancellation; it will result in additional noise within the passenger cabin. The anti-noise generated from the vibration sensor noise floor may be referred to as the Sensor Noise Floor Anti-Noise (SNFAN). An SNFAN level may be estimated by multiplying the vibration sensor noise floor by the W-filter and then by an estimate of the secondary path, S(z), from the anti-noise generating speaker (e.g., speaker 424) to a location in the passenger cabin. One embodiment to prevent the sensor noise floor from resulting in the creation of SNFAN is to store an estimate of the sensor noise floor in controller 438. The noise signal X(n) can be compared to the stored noise floor value in one or more frequency ranges or frequency bins. For instance, the difference between the noise signal X(n) and the stored noise floor value can be compared to a predetermined threshold. If the difference does not exceed the predetermined threshold (i.e., the noise signal X(n) is not sufficiently greater in magnitude than the stored noise floor value), then an RNC disabling or attenuating approach can be employed to prevent this creation of SNFAN in the passenger cabin, or to reduce its playback level.

According to another embodiment, the controller 438 may be configured to compute the anti-noise due to the noise floor of the vibration or other sensors 408 that create noise signal X(n). With the RNC system 400 deactivated, the SNFAN level can be compared in one or more frequency bands to the actual SPL at a location in the vehicle as measured by one or more of the microphones 412 disposed about the passenger cabin. If the differences in levels between the SNFAN and the in-cabin SPL are less than a predetermined threshold, the RNC system may remain deactivated. Alternatively, the anti-noise signal may be attenuated. To this end, the RNC system 400 may further include an attenuator 440 to prevent the noise floor from the sensors 408 from being audible in the passenger cabin. The attenuator 440 may apply attenuation between the vibration sensor output and the speaker input at an appropriate level to not allow the amplified sensor noise floor in increase the in-cabin SPL more than a predetermined amount. As shown in FIG. 4, the attenuator 440 may attenuate the anti-noise signals Y(n) output from the controllable filters 418 (i.e., the W-filters) to generate an attenuated anti-noise signal Y'(n). In an embodiment, the same attenuation applied by attenuator 440 may be applied to the error signal e(n) by another attenuator (not shown) before it enters adaptive filter controller 420 to achieve optimal and stable LMS adaptation of the W-filters 418. With RNC active, the anti-noise signal is detected by the error microphones 412 and can optionally be subtracted out of the error signal e(n), as shown in FIG. 4, to arrive at an accurate estimate of the in-cabin sound pressure level (IC SPL).

In alternate embodiments, the attenuator 440 that attenuates the anti-noise signal Y(n) could be moved to attenuate noise signal X(n), or directly attenuate filter coefficients W(z). A reduction of any of these signals or filters by 2 dB has the same net effect on the anti-noise generated in the vehicle—a reduction of 2 dB SPL.

Although this attenuation may prevent the noise floor of the sensor 408 from being audible in the passenger cabin, it will also reduce the anti-noise signal sent to the speaker 424. This, in turn, may reduce the road noise cancellation effect in some frequency ranges. In an embodiment, the attenuation may be chosen to limit the noise gain by the addition of SNFAN in a frequency range by 1.0 dB. Multiband processing can be applied so that this increase in SPL due to the SNFAN can be limited in one or more frequency bands. Thus, each frequency band may have its own predetermined audibility threshold. If multiband processing is used, the highest magnitude attenuation from any band can be used as the single attenuation value in attenuator 440 for all the bands. In an alternate embodiment, it is possible to apply different attenuations in each of the 2 or more bands. However, this additional filtering may increase the latency or change the anti-noise phase and, therefore, may further reduce the RNC effect. For example, the spectral level in the 300-600 Hz octave band could be compared to the background noise level, and attenuation may be applied such that the SPL only increases by 0.4 dB in this frequency band due to the presence of the anti-noise generated from the sensor noise floor.

Applying attenuation to the anti-noise signal Y(n) in the aforementioned manner may effectively delay the turn-on of the RNC system 400 or its corresponding RNC algorithm relative to using a vehicle speed threshold of 0 mph. Similarly, applying this attenuation to a decelerating vehicle (i.e., when the difference between the in-cabin SPL and the SNFAN level exceeds a threshold) can effectively deactivate RNC. This is because attenuating the output anti-noise signal may reduce the amount of RNC. Continuously increasing the level of attenuation in attenuator 440 may eventually reduce the RNC effect to the point of no cancellation, which has the audible effect of deactivating RNC. In an alternate embodiment, RNC may be "turned on" slowly, using decreasing attenuation, as the predetermined threshold is approached and passed. This may provide hysteresis and prevent undesirable and abrupt ON-OFF-ON toggling of the RNC system. The end result may be that over a small range of increases in speed, the in-cabin SPL may grow in amplitude such that the difference between in-cabin SPL and SNFAN level approaches or increases above the predetermined threshold, thereby causing a gradual reduction in the attenuation after the W-filter is applied. As an example, when a vehicle accelerates from 13 mph to 20 mph, the in-cabin SPL may increase in amplitude such that the attenuation applied to the anti-noise signal is reduced from 5 dB (i.e., some attenuation) to 0 dB (i.e., no attenuation). This may have the perceived effect of RNC gradually turning on as the predetermined threshold is approached due to vehicle acceleration or an increase in vehicle speed. It may also have the perceived effect of RNC gradually turning off as the predetermined threshold is approached from the other direction due to vehicle deceleration.

In a first embodiment, the controller 438 may estimate an SNFAN level (e.g., SNFAN SPL) by multiplying the actual output signals of the sensors 408 by the complex W-filter coefficients (i.e., coefficients of the controllable filters 418). The results of this process may be summed, as shown by the block diagram in FIG. 2, and the sum may be multiplied by the estimated secondary path, S'(z), to predict the SPL at a location in the passenger cabin. The location could be any location, such as the location of a microphone 412, the location of a passenger's ear, or near a passenger's head. The controller 438 may compare the SNFAN SPL to an in-cabin SPL. In an embodiment, the in-cabin SPL may be the actual SPL sensed by a microphone 412 at the same location as the estimated SNFAN SPL. Alternate embodiments may utilize the SPL of an in-cabin microphone at an alternate location. When RNC is deactivated, the in-cabin microphone 412 will not sense any acoustic anti-noise because the RNC system 400 is not generating anti-noise.

When RNC is activated, a portion of the in-cabin microphone output signal (i.e., the error signal e(n)) will be attributable to the airborne anti-noise. In one or more embodiments, this portion of the microphone error signal that is attributed to airborne anti-noise may be removed to form a better estimate of the in-cabin noise level attributed from other sources (e.g., road noise, engine noise, HVAC noise, music, etc.). As shown, when RNC is activated, the component of the microphone error signal e(n) due to the airborne anti-noise may optionally be removed to generate the in-cabin SPL (IC SPL) value. This results in an estimate of the in-cabin SPL that is not affected by the presence of the SNFAN SPL or other anti-noise SPL, allowing for a more apt comparison of the two values by the controller 438. Specifically, as illustrated in FIG. 4, the attenuated anti-noise signal Y'(n) may be multiplied by the estimated secondary path S'(z) before being subtracted from the microphone error signal e(n) to generate an estimate of the in-cabin SPL that is not influenced by the airborne anti-noise, which can include the SNFAN.

Figure 5:
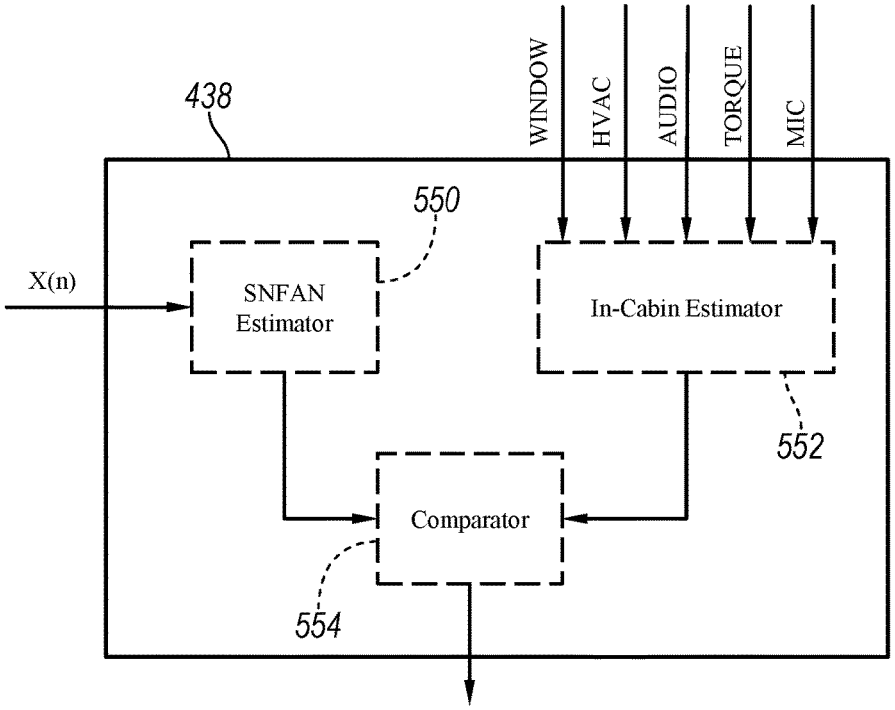
FIG. 5 is an example block diagram of the controller in FIG. 4, in accordance with one or more embodiments of the present disclosure.

FIG. 5 is an example block diagram of the controller 438 showing various potential inputs and outputs, in accordance with one or more embodiments of the present disclosure. For example, the controller 438 may include an SNFAN level estimator 550, an in-cabin sound level measurer or estimator 552, and a comparator 554 for comparing an SNFAN level to an in-cabin sound level to determine an attenuation level to be applied to the anti-noise signal Y(n) by attenuator 440, as will be described in greater detail below with respect to FIG. 6.

Figure 6:
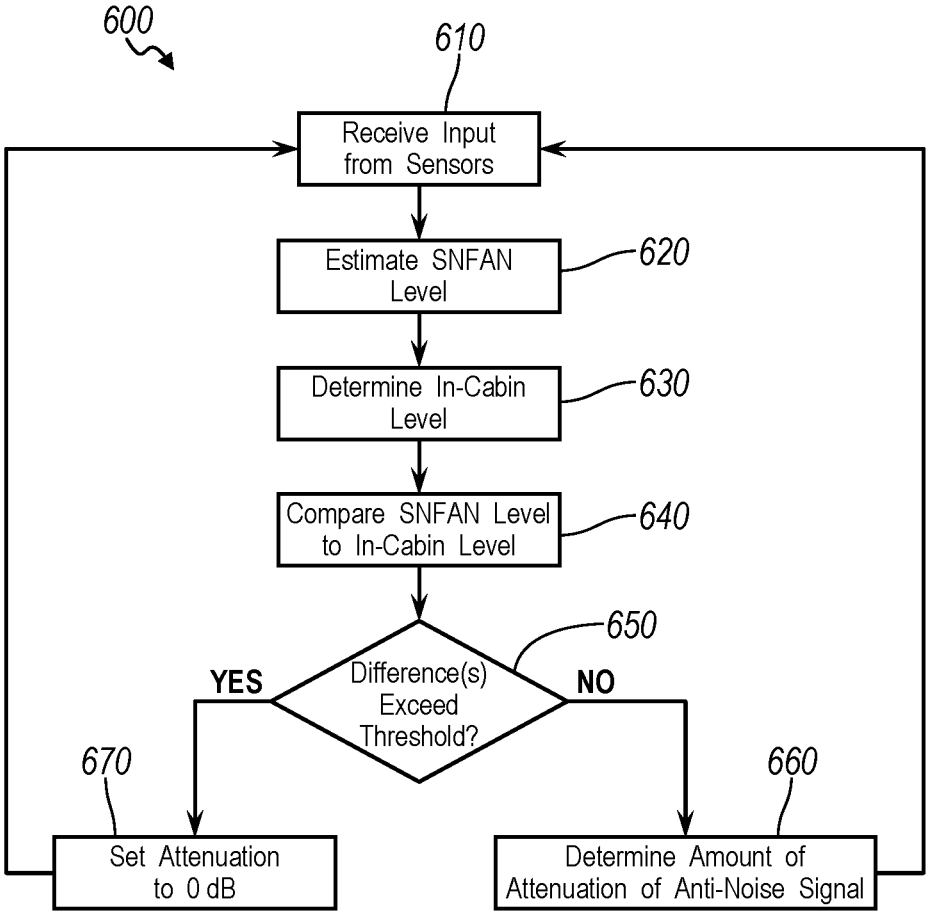
FIG. 6 is a flowchart depicting a method for reducing the audibility of the sensor noise floor in an RNC system, in accordance with one or more embodiments of the present disclosure.

FIG. 6 is a flowchart depicting a method 600 for preventing the sensor noise floor from being audible in a passenger cabin of a vehicle with an RNC system. Various steps of the disclosed method may be carried out by the controller 438, either alone, or in conjunction with other components of the RNC system 400. At step 610, the RNC system 400 may receive sensor signals, such as noise signals X(n) from at least one sensor 408 and/or error signals e(n) from at least one microphone 412. For instance, a group of samples of time data from an output channel of the sensor 408 and the microphone 412 may be received. The group of samples of time data may form one digital signal processing (DSP) frame. In an embodiment, 128 time samples of the output from a sensor (i.e., sensor 408 or microphone 412) may form a single DSP frame. In alternate embodiments, greater or fewer time samples may compose a single frame.

At step 620, the controller 438 may estimate a level of the SNFAN using, for example, the SNFAN level estimator 550. As previously described, the SNFAN level may be an estimate of the SPL caused by the sensor noise floor anti-noise at a location in the passenger cabin. The SNFAN SPL may be estimated by multiplying the sensor noise floor by the W-filter coefficients 418, summing the products (as shown by the block diagram in FIG. 2), and then multiplying the sum by the estimated secondary path, S'(z). Rather than a single SNFAN SPL, the controller 438 may compute several frequency dependent SNFAN levels at different locations within the vehicle. Moreover, various alternate methods of computing an estimate of the SNFAN level are possible using, for example, alternate values for the W-filter coefficients. In an embodiment, the W-filter coefficients used by the controller 438 to calculate the SNFAN SPL may be stored values that are used to initialize the RNC performance upon turn-on of the RNC system 400. In another alternate embodiment, the W-filter coefficients may be W-filter values that were adapted during a previous operation of the RNC system 400. In yet another embodiment, the W-filters coefficients may be the current values in controllable filter 418 that are in the process of being actively updated and adapted by the LMS adaptive filter controller 420. Moreover, the W-filter coefficients used to calculate the SNFAN level may be selected from stored W-filter values associated with a particular road type, as may be determined by engineers tuning the system. In yet another embodiment, the W-filter coefficients may be known worst case, highest magnitude W-filter values. Such W-filter coefficients may therefore reflect W-filter values that result in the maximum achievable SNFAN SPL at an error microphone. In other embodiments, the W-filter coefficients may be averaged values of W-filters or W-filters with a predetermined added multiplicative complex gain factor.

In addition to the various values that may be used for the W-filter coefficients, the sensor noise floor used to compute an estimate of the SNFAN level may be provided using various alternate methods. In an embodiment, the sensor noise floor may be obtained from the actual output signals from the sensors 408. For instance, the noise floor of one or more sensors 408 may be automatically measured by the RNC system 400 at a predetermined time. Such a predetermined time may include when the RNC system 400 turns on, when the vehicle is known to be devoid of acceleration inducing occupants and events, or just prior to activation of the vehicle's engine. In an alternate embodiment, the noise floor of one or more of the sensors 408 may be programmed into the RNC system 400.

At step 630, the controller 438 may determine an in-cabin sound level to subsequently compare to the SNFAN level. The in-cabin sound level may be indicative of the actual sound in the vehicle at one or more of the microphones 412. In one or more embodiments, the in-cabin sound level may be an in-cabin SPL that may be compared to the SNFAN SPL. Alternatively, the controller 438 may determine multiple frequency dependent in-cabin sound levels at various positions within the passenger cabin. Several methods may be employed to determine the in-cabin sound level. One such method includes direct measurement of the in-cabin SPL at a microphone 418 in the same location as the computed SNFAN SPL. Alternate embodiments may utilize an in-cabin microphone at an alternate location. Various other methods for determining the in-cabin SPL may include predicting or estimating the in-cabin SPL, thereby eliminating the need to directly measure it using a microphone. For instance, the controller 438 may be configured to access a lookup table stored in memory of typical in-cabin SPL values versus vehicle speed. The controller 438 may receive a SPEED signal indicative of the vehicle speed from a network bus, such as a Controller Area Network (CAN) bus. The lookup table of vehicle speed versus in-cabin SPL may be programmed by engineers during the tuning of the RNC algorithm. Moreover, the lookup table values may be frequency dependent.

In another embodiment, the controller 438 may receive inputs from other in-cabin sound generating systems such as the music system, the HVAC system, the window state, and the engine torque and, or accelerator pedal position indicative of engine noise. The controller 438 may receive signals indicative of one or more of these in-cabin sound generating systems to produce an estimate of the in-cabin SPL using, for example, the in-cabin estimator 552. In an embodiment, the controller 438 may receive a WINDOW signal that represents the current setting or state of one or more windows in the vehicle (e.g., partially open, fully open, or closed). The controller 438 may also receive an HVAC signal indicative of the current settings of an HVAC system (e.g., defrost on/off, and fan speed, etc.). The controller 438 may also receive an AUDIO signal indicative of the music playing in the passenger cabin or, in some embodiments, the volume and genre, equalization, fade, or the like. For instance, the music genre setting may set an average level and crest factor of the music, a four-channel volume setting, and/or the balance and fade settings. In one or more embodiments, the AUDIO signal may be single or split band analyzed to determine its effective signal amplitude or energy in each frequency band and the volume knob setting may be used as an additional guiding signal. The controller 438 may also receive a TORQUE signal representing an accelerator pedal position or engine torque output that is indicative of the engine noise level. These signals (WINDOW, HVAC, AUDIO, TORQUE) may be obtained from the CAN bus (not shown). A MIC signal, corresponding to the microphone error signal e(n) optionally with the airborne anti-noise component removed (i.e., IC SPL), as described above, may also be received by the controller 438. Using one or more of these signals (MIC, WINDOW, HVAC, AUDIO, TORQUE, SPEED), the controller 438 may estimate the in-cabin sound level.

Once the SNFAN level and the in-cabin sound level are estimated, measured or otherwise determined, they may be processed and compared at step 640. For instance, an SNFAN level may be compared to an in-cabin level. The comparison may include calculating a difference between the in-cabin sound level and the SNFAN level. The controller 438 may carry out this step using the comparator 554, as shown in FIG. 5. When frequency dependent levels are computed and compared in step 640, the comparison process may occur in one or more frequency bands or ranges. At step 650, the calculated difference(s) between the in-cabin sound level and the SNFAN level may be compared to a predetermined threshold. If the difference in levels does not exceed the predetermined threshold, the sensor noise floor may be audible in the passenger cabin absent some mitigating action. At a minimum, the RNC system 400 may be turned off when the difference in levels does not exceed the predetermined threshold. Alternatively, the calculated difference may be used to compute an attenuation level to be applied to the anti-noise signal Y(n) by in the attenuator 440, as provided at step 660. The attenuation level may vary based on the magnitude of the difference between the SNFAN level and the in-cabin sound level. In certain cases, the amount of attenuation to be applied to the anti-noise signal Y(n) may have the same effect as turning off RNC. As the difference increases, the attenuation level may decrease. The attenuation level may be determined using a lookup table of attenuation values based on the computed difference between in-cabin sound level and SNFAN level. Note that in RNC systems with multiple speakers, multiple anti-noise signals Y(n) exist. In various embodiments, identical or different attenuation levels may be applied to each of these multiple anti-noise signals Y(n) to reduce the audibility of SNFAN.

In an embodiment, the attenuation level may be computed to have the addition of the anti-noise generated by the speaker 424 only increase the in-cabin SPL by 0.5 dB. As understood by those skilled in the art of acoustics, when adding uncorrelated signals, the addition of two signals of equal amplitude results in the increase in SPL of 3 dB because the signal energies of uncorrelated signals add. It is also known that the addition of uncorrelated signals that differ by 9 dB SPL increases the SPL by 0.5 dB. Therefore, for example, a SNFAN SPL of 66 dB when added to an in-car SPL of 75 dB results in a 75.5 dB level. Likewise, in an embodiment where a 1 dB increase in level due to the SNFAN is the target, an SNFAN SPL of 69 dB when added to the 75 dB in-cabin sound level results in a level of 76 dB. Note that other thresholds of acceptable noise boosting are possible. It is well known in psychoacoustics that the detectability of a noise level increase depends on both a level change and on the signal bandwidth and signal character.

If the calculated difference(s) between the in-cabin sound level and the SNFAN level exceed the predetermined threshold, the attenuation level set by the controller 438 may be 0 dB, as provided at step 670. This has the effect of applying no attenuation to the anti-noise signal Y(n). No attenuation may be necessary when the in-cabin sound level is sufficiently greater than the SNFAN level because the sensor noise floor will not be audible.

If the aforementioned process of computing an attenuation level is conducted for every DSP frame of incoming vibration sensor data, it may appear that the RNC system is frequently activating and deactivating due to rapid changes in the magnitude of the attenuation level by attenuator 440. To prevent this from occurring, smoothing or averaging may be applied to the analysis of the vibration sensor and microphone data, or to the attenuation factor computed. Moreover, averaging techniques that result in a fast increasing or slow decreasing attenuation coefficient may be used to further reduce the audibility of the sensor noise floor. Additionally, the controller 438 may utilize two different predetermined thresholds to provide hysteresis and prevent frequent ON/OFF toggling of the RNC system. The difference between the in-cabin sound level and the SNFAN level may be compared to a first threshold for determining when to turn on the RNC system and a second threshold for determining when to turn off the RNC system.

To reduce the audibility of the sensor noise floor, the RNC system may effectively delay turning on upon vehicle acceleration relative to systems employing a non-zero speed-based activation. Similarly, the RNC system of the present disclosure may deactivate sooner upon vehicle deceleration relative to systems that only turn off when vehicle speed in zero.

In the foregoing specification, the inventive subject matter has been described with reference to specific exemplary embodiments. Various modifications and changes may be made, however, without departing from the scope of the inventive subject matter as set forth in the claims. The specification and figures are illustrative, rather than restrictive, and modifications are intended to be included within the scope of the inventive subject matter. Accordingly, the scope of the inventive subject matter should be determined by the claims and their legal equivalents rather than by merely the examples described.

For example, the steps recited in any method or process claims may be executed in any order and are not limited to the specific order presented in the claims. Equations may be implemented with a filter to minimize effects of signal noises. Additionally, the components and/or elements recited in any apparatus claims may be assembled or otherwise operationally configured in a variety of permutations and are accordingly not limited to the specific configuration recited in the claims.

Those of ordinary skill in the art understand that functionally equivalent processing steps can be undertaken in either the time or frequency domain. Accordingly, though not explicitly stated for each signal processing block in the figures, the signal processing may occur in either the time domain, the frequency domain, or a combination thereof. Moreover, though various processing steps are explained in the typical terms of digital signal processing, equivalent steps may be performed using analog signal processing without departing from the scope of the present disclosure.

Benefits, advantages and solutions to problems have been described above with regard to particular embodiments. However, any benefit, advantage, solution to problems or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the inventive subject matter, in addition to those not specifically recited, may be varied or otherwise particularly adapted to specific environments, manufacturing specifications, design parameters or other operating requirements without departing from the general principles of the same.

What is claimed is:

1. A method for reducing the audibility of a sensor noise floor in a feed-forward road noise cancellation (RNC) system, the method comprising:

estimating a sensor noise floor anti-noise (SNFAN) level, the SNFAN level representing an amount of anti-noise at a location in a passenger cabin of a vehicle due to a noise floor of at least one sensor;

determining an in-cabin sound level in the passenger cabin; and adjusting an attenuation level of an anti-noise signal to be radiated into the passenger cabin by at least one speaker based on a comparison of the in-cabin sound level to the SNFAN level.

2. The method of claim 1, wherein the SNFAN level and the in-cabin sound level are sound pressure levels.

3. The method of claim 1, wherein the SNFAN level and the in-cabin sound level are sound parameters computed in one or more frequency bands.

4. The method of claim 1, wherein estimating the SNFAN level comprises:

for at least one speaker in the RNC system, multiplying the noise floor of the at least one sensor by W-filter coefficients associated with the at least one speaker;

summing the products of the noise floor and the W-filter coefficients; and multiplying the sum by an estimated secondary path, S'(z), between the at least one speaker and the location in the passenger cabin.

5. The method of claim 1, wherein the in-cabin sound level is based on a direct measurement of sound pressure by a microphone in the passenger cabin.

6. The method of claim 1, wherein the in-cabin sound level is estimated based on inputs from in-cabin sound generating systems.

7. The method of claim 1, wherein determining an in-cabin sound level in the passenger cabin comprises:

measuring a sound pressure level using a microphone in the passenger cabin to obtain an error signal; and removing a component of the sound pressure level attributed to anti-noise radiated by the at least one speaker by multiplying an attenuated anti-noise signal by an estimated secondary path, S'(z), between the at least one speaker and the location in the passenger cabin and subtracting a product of the multiplication from the error signal.

8. The method of claim 1, wherein adjusting the attenuation level of an anti-noise signal comprises:

calculating a difference between the in-cabin sound level and the SNFAN level; and selecting the attenuation level based on the difference.

9. The method of claim 8, wherein selecting the attenuation level based on the difference includes selecting the attenuation level from a lookup table based on the difference.

10. The method of claim 8, wherein the attenuation level is set to zero when the difference exceeds a predetermined threshold.

11. A road noise cancellation (RNC) system for a vehicle comprising:

at least one sensor configured to generate a noise signal in response to an input, the sensor having a noise floor;

a controller, including a processor and memory, programmed to:

estimate a sensor noise floor anti-noise (SNFAN) level, the SNFAN level representing an amount of anti-noise at a location in a passenger cabin of the vehicle due to the noise floor of the at least one sensor;

determine an in-cabin sound level in the passenger cabin; and set an attenuation level based on a comparison of the in-cabin sound level to the SNFAN level; and an attenuator configured receive an anti-noise signal from a controllable filter and generate an attenuated anti-noise signal to be radiated into the passenger cabin as anti-noise by at least one speaker based on the attenuation level.

12. The RNC system of claim 11, wherein the SNFAN level and the in-cabin sound level are sound pressure levels.

13. The RNC system of claim 11, wherein the SNFAN level and the in-cabin sound level are sound parameters computed in one or more frequency bands.

14. The RNC system of claim 11, wherein the controller programmed to estimate the SNFAN level comprises the controller being programmed to:

for the at least one speaker in the RNC system, multiply the noise floor of the at least one sensor by W-filter coefficients associated with the at least one speaker;

sum the products of the noise floor and W-filter coefficients; and multiply the sum by an estimated secondary path, S'(z), between the at least one speaker and the location in the passenger cabin.

15. The RNC system of claim 11, wherein the noise floor is obtained from actual output signals from the at least one sensor.

16. The RNC system of claim 11, wherein the noise floor is a programmed value.

17. The RNC system of claim 11, wherein the attenuation level set by the controller is based on a difference between the in-cabin sound level and the SNFAN level.

18. A computer-program product embodied in a non-transitory computer readable medium that is programmed for road noise cancellation (RNC), the computer-program product comprising instructions for:

receiving a noise signal from at least one sensor;

comparing the noise signal to a stored noise floor value indicative of an estimate of a sensor noise floor for the at least one sensor; and adjusting an attenuation level of an anti-noise signal to be radiated into the passenger cabin by at least one speaker based on the comparison of the noise signal to the stored noise floor value.

19. The computer-program product of claim 18, wherein the instructions for comparing the noise signal to a stored noise floor value comprises:

calculating a difference between the noise signal and the stored noise floor value; and comparing the difference to a predetermined threshold.

20. The computer-program product of claim 19, wherein the instructions for adjusting the attenuation level of an anti-noise signal comprises:

selecting the attenuation level when the difference does not exceed the predetermined threshold, wherein the attenuation level is based on the difference.

* * * * *